United States Patent [19]

Pulley

[11] 4,023,763

[45] May 17, 1977

[54] HOLDER FOR RECIPE CARDS AND THE LIKE

[76] Inventor: Harvey E. Pulley, 3366 W. 90th, South, West Jordan, Utah 84084

[22] Filed: Dec. 5, 1975

[21] Appl. No.: 637,896

[52] U.S. Cl. ..... 248/452; 248/441 B; 248/316 D; 248/284; 116/119

[51] Int. Cl.[2] ..... B42D 9/00

[58] Field of Search ..... 116/119, 114 R; 248/486, 485, 479, 284, 316 B, 316 D, 452, 441 B; 24/67.5

[56] References Cited

UNITED STATES PATENTS

| | | | |
|---|---|---|---|
| 664,664 | 12/1900 | Montgomery | 248/452 |
| 1,327,608 | 1/1920 | Barnard | 248/485 |
| 2,548,389 | 4/1951 | Neikirk | 24/67.5 |
| 2,862,328 | 12/1958 | Wadsworth | 248/452 |
| 3,583,358 | 6/1971 | Hanson | 116/119 |

*Primary Examiner*—S. Clement Swisher
*Assistant Examiner*—Denis E. Corr
*Attorney, Agent, or Firm*—Criddle, Thorpe & Western

[57] ABSTRACT

A recipe card holder includes a bracket suitable for being mounted to a surface, a support plate or base, and an intermediate joining element, one end of which is pivotally attached to the top of the support plate and the other end of which is pivotally attached to the bracket so that when the bracket is mounted to the under-surface of a shelf or the like, the support plate may be pivoted between a pendant position and a position in which the plate is generally parallel with the under-surface. A clip is mounted on the support plate near the top thereof for holding a recipe card or the like against the support plate for viewing. A pointer element is slideably mounted on one side edge of the support plate to enable marking various vertically arranged entries on a card being held by the card holder.

1 Claim, 6 Drawing Figures

HOLDER FOR RECIPE CARDS AND THE LIKE

BACKGROUND OF THE INVENTION

This invention relates to a pendant holder suitable for mounting on the underneath surface of shelves or cabinets and adapted to hold recipe cards and the like for viewing.

It is the custom of many homemakers to print new recipes on file cards for filing in a box or similar container. With such a filing system, new recipes may be easily added to the file at any location therein without disrupting the order of already filed cards. Also, recipe cards may be easily removed from the file both for use by the homemaker and then replaced after such use. Typically, when the homemaker decides to use a recipe printed on one of the cards, he or she removes the card from the file container and places it on a counter for ready reference while the recipe is being prepared. In such a position on the counter, of course, recipe ingredients might be spilled on the card thereby soiling it and making subsequent replacement of the card necessary. Also, the card takes up needed room on the counter and is subject to being bumped from the counter onto the floor.

Countertop recipe card holders could be improvised, but such holders would offer little improvement over simply placing the recipe cards directly on the countertop.

SUMMARY OF THE INVENTION

It is an object of the present invention to provide a new and improved card holder which is adapted to suspend recipe cards and the like above a countertop.

It is another object of the present invention to provide a card holder adapted for mounting on the underneath surface of a shelf or cabinet for holding and suspending therebeneath recipe cards.

It is still another object of the present invention to provide such a card holder which may be pivoted upwardy, generally adjacent to the underneath surface on which the card holder is mounted.

It is a further object of the present invention, in accordance with one aspect thereof, to provide such a card holder having an indicator element carried thereby for temporarily making or indicating various vertically positioned items printed on a recipe card or the like held by the holder.

The above and other objects of the present invention are realized in an illustrative embodiment of a card holder which includes a bracket member adapted for mounting on the underneath surface of a shelf or the like. The bracket includes a flange which extends generally downwardly when the bracket member is so mounted. The card holder also includes a generally flat support plate, one end of which is mounted to the flange to pivot between a pendant position and a horizontal position adjacent the underneath surface to which the bracket is mounted. A clip member is included on the support plate so that a portion of the clip member is biased against one surface of the plate to hold the card inserted between that portion and the plate.

In accordance with one aspect of the invention, an indicator element is mounted on side edge of the support plate to slide along the side edge and indicate or mark ingredients or preparation steps printed on a card held by the card holder.

BREIF DESCRIPTION OF THE DRAWINGS

The above and other objects, features and advantage of the present invention will become apparent from a consideration of the following detailed description presented in connection with the accompanying drawings in which.

DETAILED DESCRIPTION

Figure 1:
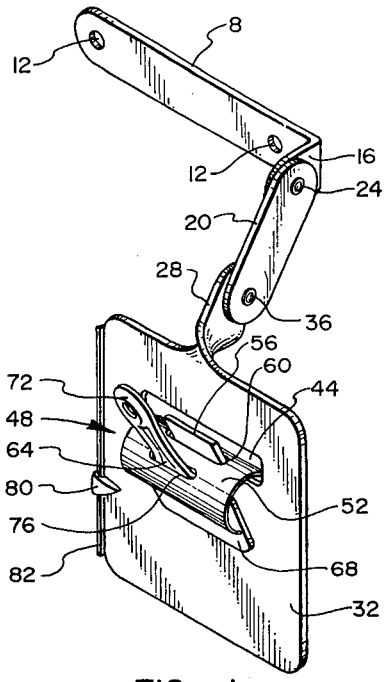
FIG. 1 is a perspective view of a card holder made in accordance with the present invention.
Figure 2:
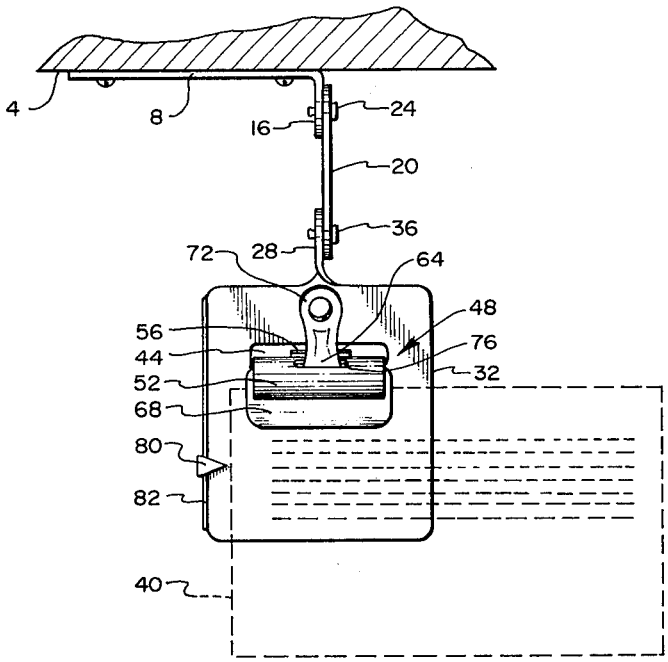
FIG. 2 is a front elevational view of the card holder of FIG. 1 mounted to depend from a generally horizontal surface.

Referring to the drawings, there is shown a holder for recipe cards and the like adapted to be mounted on an underneath surface 4 (FIG. 2 and composite FIG. 3) of a shelf, cabinet, etc. The holder includes an elongate bracket member 8 having a pair of holes 12 through which screws or nails may be inserted to mount the bracket on the underneath surface 4. A flange 16 extends at generally a right angle from one end of the bracket member 8 so that when the bracket member is mounted on the underneath surface 4, the flange 16 extends downwardly.

One end of an intermediate joining arm 20 is pivotally attached to the flange 16 by a rivot 24 of other suitable fastening element. The other end of the intermediate arm 20 is pivotally attached to a flange 28 of a support base or plate 32, again by a rivot 36 or other fastening element. The intermediate arm 20 is pivotally joined to the flanges 16 and 28 so that when the arm and support plate 32 are positioned in some attitude, they remain in that attitude until repositioned. That is, the intermediate arm 20 is attached in a manner to present some resistance to pivoting of the arm.

The flange 28 extends from the upper edge of the support plate 32 and is twisted at about 90° with respect to the plane of the support plate. The support plate 32 is generally flat and may be of a variety of sizes to support a recipe card such as that shown by dotted line 40 in FIG. 2.

An opening 44 is formed in the support plate 32 near the upper edge thereof adjacent the flange 28 for receiving a clip 48 which is mounted therein. The clip 48 is adapted to engage and hold a recipe card in place against the front face of the support plate 32. The clip 48 is generally similar to commonly used spring clips. The clip includes a strip of elastic material 52 formed into a demi-cylinder (less than full) with the ends of the strip generally adjacent to and biased towards one another. One end of the strip 52 is inserted through the opening 44 to curve downwardly from the opening to contact the back face of the support plate 32 as best seen in composite FIG. 3 and FIG. 4. A tab 56 projects upwardly and forwardly from the bottom margin of the opening 44 through an opening 60 located on the strip 52. The tab 56 together with a lever element 64 function to maintain the clip 48 securely in place on the support plate 32.

The lever element 64, which is standard for clips of the type mentioned, includes an engagement portion 68 whose width is about the same as the length of the strip 52, and a grasping or finger portion 72 which is integral with and extends upwardly from the top edge of the engagement portion 68. The lever element 64 is disposed so that the engagement portion 68 thereof is positioned within the strip 52 with the finger portion 72 extending upwardly and forwardly through another opening 76 in the strip. The strip 52 curves forwardly and downwardly from the opening 44 in the support plate 32 and contacts the engagement portion 68 of the lever element 64 to force the engagement portion 68 against the front face of the support plate.

To insert a card in the holder shown in the drawings, the finger portion 72 of the lever element 64 is pressed toward the support plate 32 so that the engagement portion 68 of the lever element outwardly of the support plate to enable insertion thereunder of the card. The lever element 64 is then allowed to spring back so that the engagement portion 68 engages the card and holds it in place.

Figure 5:
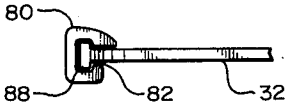
FIG. 5 is a fragmented bottom end view of the card holder showing the structure for mounting the indicator element on the support plate.

An indicator element 80, formed into a pointer, is slideably mounted on one side edge 82 of the support plate 32 to pivot laterally toward the other edge of the support plate. As best seen in FIG. 5, the side edge 82 of the support plate is T-shaped and the indicator element 80 is formed with a corresponding T-shaped channel 88 for receiving the edge 82. The indicator element 80 may simply be slid onto the T-edge 82 at the upper or lower corner of the support plate 32 and then moved to any desired position. A leaf spring or other drag (not shown) could be incorporated in the channel 88 of the indicator element 80 to rub against the T-edge 82 of the support plate 32 to hold the indicator element in any position in which it is placed along the side edge of the support plate. The indicator element 80 is useful in indicating or marking different items which may be vertically arranged on a recipe card. Thus, in the course of preparing a recipe, as each step is completed, the indicator element 80 could be moved downwardly to identify the next step to be taken so that the homemaker would not lose her place in the preparation of the recipe.

Figure 3A:
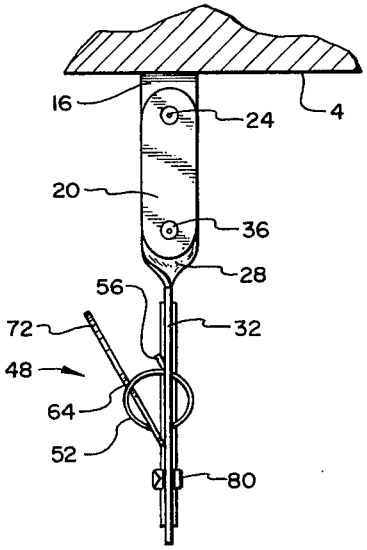
FIGS. 3A and 3B show side-elevational views of the card holder of FIG. 2 disposed in dependent and horizontal positions respectively.
Figure 3B:
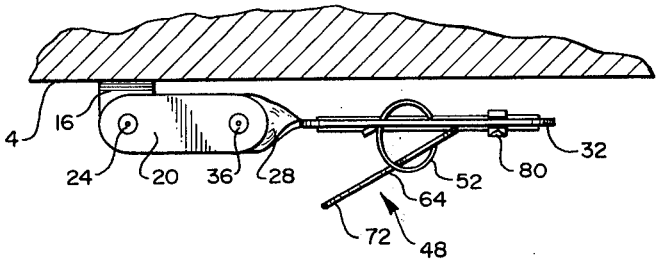
Figure 4:
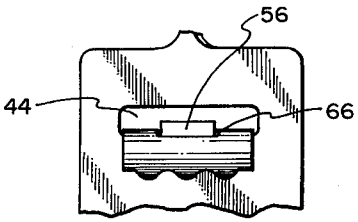
FIG. 4 is a fragmented view of the back of the support plate and clip of the card holder of FIG. 1.

With the recipe card holder structure described, the holder can be mounted on the underneath surface of a shelf, cabinet, or other similar structure and then be pivoted upwardly out of the way, as shown in FIG. 3B, when not in use or pivoted downwardly to a position dependent from the shelf or cabinet, as shown in FIG. 3A, when used to hold the recipe card. With this structure, recipe cards could be maintained out of the way of the materials and utensils used in cooking and thus free from soiling. Of course, it should be understood that the card holder described could be used in a variety of other similar environments such as, for example in a drugstore to hold cards bearing prescription formulas used by druggists in preparing prescriptions for customers.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A pendant recipe card holder comprising a bracket member adapted for mounting on the underneath surface of a shelf or similar structure, and including a flange which extends generally downwardly when the bracket member is so mounted, a generally flat support plate having a front face and a back face, one end of said support plate being attached to the flange to pivot between a pendant position and a position in which the plate is generally parallel with said underneath surface to which the bracket is mounted, said support plate having an opening therein near said one end of the plate and a tab extending from the margin of the opening generally upwardly of the margin, and a clip member comprising an elastic strip of material having a pair of openings in the wall thereof and formed into a demi-cylinder so that the ends of the strip are generally contiguous, said strip being disposed so that one end of the strip extends through the opening in the support plate and curves downwardly to engage the back face of the support plate, so that the tab extends through one of the openings in the strip, and so that the other end of the strip curves forwardly and downwardly of the support plate, and a lever element having an engagement portion and a finger portion extending from the engagement portion, said lever element being disposed so that the finger portion thereof extends through the other opening in the strip and the engagement portion is positioned between said other end of the strip and the support plate and is forced by said other end to press against the front face of the support plate.

* * * * *